US006045236A

United States Patent [19]

Cheng et al.

[11] Patent Number: 6,045,236

[45] **Date of Patent: *Apr. 4, 2000**

[54] TWIST ON/OFF AND ADJUSTABLE FOCUS FLASHLIGHT

[75] Inventors: Leo K. F. Cheng, Kowloon; Eddie Y. H. Lo, Kowloon Tong; Victer Au-Yeung Tin Shun, Taj Haung, all of The Hong Kong Special Administrative Region of the People's Republic of China; Roger Q. Smith, Reisterstown, Md.

[73] Assignee: Black & Decker Inc., Newark, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/694,895

[22] Filed: Aug. 9, 1996

[51] Int. Cl.[7] ..... F21L 7/00

[52] U.S. Cl. ..... 362/188; 362/187; 362/205

[58] Field of Search ..... 362/187, 188, 362/197, 202, 203, 205

[56] References Cited

U.S. PATENT DOCUMENTS

| | | | |
|---|---|---|---|
| 1,455,246 | 2/1923 | Staples | 362/188 |
| 1,578,512 | 3/1926 | Gravely | 362/188 |
| 1,608,195 | 11/1926 | Barany . | |
| 1,894,606 | 1/1933 | Bennett . | |
| 2,236,384 | 3/1941 | Samuels . | |
| 2,261,536 | 11/1941 | Wood . | |
| 2,439,496 | 4/1948 | Szantay . | |
| 2,518,437 | 8/1950 | Amstutz . | |

(List continued on next page.)

FOREIGN PATENT DOCUMENTS

| | | |
|---|---|---|
| 0285349 | 10/1988 | European Pat. Off. . |
| 0434197 | 6/1991 | European Pat. Off. . |
| 0389912 | 12/1993 | European Pat. Off. . |
| 0521267 | 9/1995 | European Pat. Off. . |
| 45697 | 12/1888 | Germany . |
| 190112 | 9/1907 | Germany . |
| 365446 | 12/1922 | Germany . |
| 367434 | 1/1928 | Germany . |
| 475944 | 5/1929 | Germany . |
| 527724 | 4/1930 | Germany . |
| 512589 | 11/1930 | Germany . |
| 585079 | 9/1933 | Germany . |
| 599242 | 6/1934 | Germany . |
| 638333 | 11/1936 | Germany . |
| 93875 | 7/1949 | Germany . |
| 954362 | 7/1949 | Germany . |
| 1034768 | 7/1958 | Germany . |
| 1039631 | 3/1959 | Germany . |
| 1910112 | 2/1965 | Germany . |
| 3710147 | 10/1988 | Germany . |
| 4230673 | 3/1994 | Germany . |
| 4323274 | 1/1995 | Germany . |

*Primary Examiner*—Thomas M. Sember
*Attorney, Agent, or Firm*—Bruce S. Shapiro; Dennis A. Dearing; John D. Del Ponti

[57] ABSTRACT

The present invention is directed to an on/off switch for a flashlight having a reflector secured against axial motion. The reflector has a central opening. The flashlight includes a bulb with a base having an outer cylindrical electrical terminal. The bulb extends through the central opening of the reflector. The switch includes a bulb holder, with the bulb secured in and moving with the bulb holder. The switch also includes an electrical contact disposed in the flashlight so as to be adjacent and biased away from the cylindrical electrical terminal of the bulb. The switch also includes a ring rotatably disposed in the flashlight. The ring is mechanically linked to the bulb holder and includes an element disposed adjacent the electrical contact. Rotation of the ring causes the bulb holder and thus the bulb to move axially relative to the reflector due to the mechanical link and simultaneously causes the element to force the electrical contact against the bias and into contact with the cylindrical electrical terminal of the bulb.

10 Claims, 10 Drawing Sheets

U.S. PATENT DOCUMENTS

| | | |
|---|---|---|
| 4,286,311 | 8/1981 | Maglica . |
| 4,388,673 | 6/1983 | Maglica . |
| 4,429,351 | 1/1984 | Petzl . |
| 4,472,766 | 9/1984 | Hung . |
| 4,527,223 | 7/1985 | Maglica . |
| 4,531,178 | 7/1985 | Uke . |
| 4,570,208 | 2/1986 | Sassmannshausen . |
| 4,577,263 | 3/1986 | Maglica . |
| 4,581,686 | 4/1986 | Nelson . |
| 4,656,565 | 4/1987 | Maglica . |
| 4,658,336 | 4/1987 | Maglica . |
| 4,680,682 | 7/1987 | Parker . |
| 4,725,932 | 2/1988 | Gammache . |
| 4,777,582 | 10/1988 | Sharrah . |
| 4,821,156 | 4/1989 | Siefert et al. . |
| 4,823,242 | 4/1989 | Maglica et al. . |
| 4,843,526 | 6/1989 | Price, III . |
| 4,851,974 | 7/1989 | Maglica . |
| 4,864,474 | 9/1989 | Maglica . |
| 4,888,670 | 12/1989 | Sharrah . |
| 4,899,265 | 2/1990 | Maglica . |
| 4,942,505 | 7/1990 | Maglica . |
| 4,949,231 | 8/1990 | Wang . |
| 4,951,183 | 8/1990 | Wang . |
| 4,967,325 | 10/1990 | Shiau . |
| 5,008,785 | 4/1991 | Maglica et al. . |
| 5,113,326 | 5/1992 | Maglica . |
| 5,121,308 | 6/1992 | Maglica et al. . |
| 5,122,938 | 6/1992 | Pastusek . |
| 5,193,898 | 3/1993 | Maglica et al. . |
| 5,213,408 | 5/1993 | Shiau . |
| 5,267,130 | 11/1993 | Maglica et al. . |
| 5,309,337 | 5/1994 | Groben . |
| 5,345,370 | 9/1994 | Murray et al. . |
| 5,432,689 | 7/1995 | Sharrah et al. . |
| 5,461,552 | 10/1995 | Tillery . |

TWIST ON/OFF AND ADJUSTABLE FOCUS FLASHLIGHT

BACKGROUND OF THE INVENTION

1. Field of Invention

This invention is directed to a flashlight including an on/off mechanism which also serves to control the focus of the flashlight.

2. The Prior Art

Flashlights including switches which control both the on/off functioning and the focusing are known in the art. Such flashlights include a head which is rotatable relative to the flashlight barrel. A reflector is secured within the head. With the flashlight initially off, the head is rotated through a predetermined arc to first switch the flashlight on. Additional rotation causes relative axial movement between the bulb and the reflector to control the focusing from either a narrow beam with the bulb in a highest position relative to the reflector or a wider beam with the bulb in the lowest position relative to the reflector.

An example of a prior flashlight which incorporates both on/off functioning and focusing is shown in German Patent No. 1,039,631 which discloses a bulb socket with radially extending pins which project through helical grooves of a fixed guide cylinder and fit within an axial groove of a rotatable ring. The ring is integral with the bezel. Rotation of the bezel and ring forces both rotational and axial displacement of the socket and the bulb due to engagement of the pins in both the axial grooves of the ring and the helical grooves of the guide cylinder. The bulb moves axially relative to both a contact linked to the battery terminal and the reflector, thereby allowing both on/off control and focusing.

SUMMARY OF THE INVENTION

The present invention is directed to an on/off switch for a flashlight having a reflector secured against axial motion. The reflector has a central opening. The flashlight includes a bulb with a base having an outer cylindrical electrical terminal. The bulb extends through the central opening of the reflector. The switch includes a bulb holder, with the bulb secured in and moving with the bulb holder. The switch also includes an electrical contact disposed in the flashlight so as to be adjacent and biased away from the cylindrical electrical terminal of the bulb. The switch also includes a ring rotatably disposed in the flashlight. The ring is mechanically linked to the bulb holder and includes an element disposed adjacent the electrical contact. Rotation of the ring causes the bulb holder and thus the bulb to move axially relative to the reflector due to the mechanical link and simultaneously causes the element to force the electrical contact against the bias and into contact with the cylindrical electrical terminal of the bulb.

DETAILED DESCRIPTION OF THE PREFERRED EMBODIMENT

Figure 1:
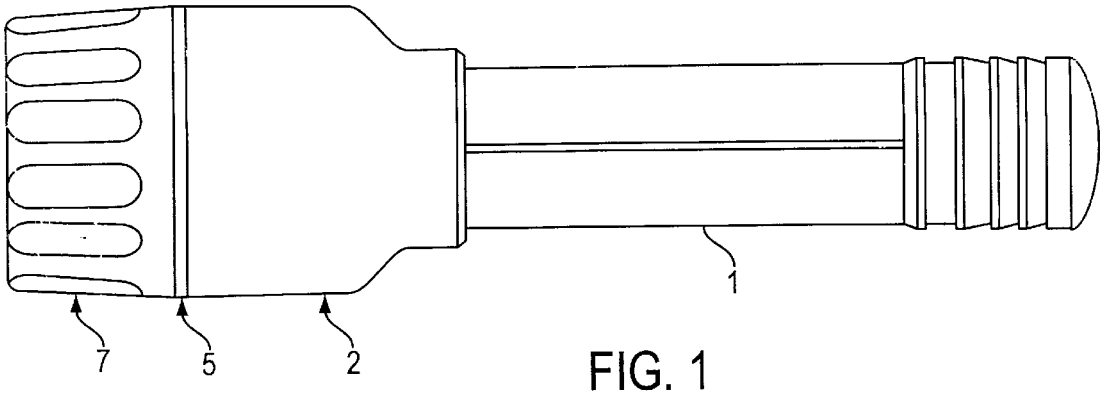
FIG. 1 is an elevational view of a flashlight according to the present invention mounted on a battery stick.
Figure 2:
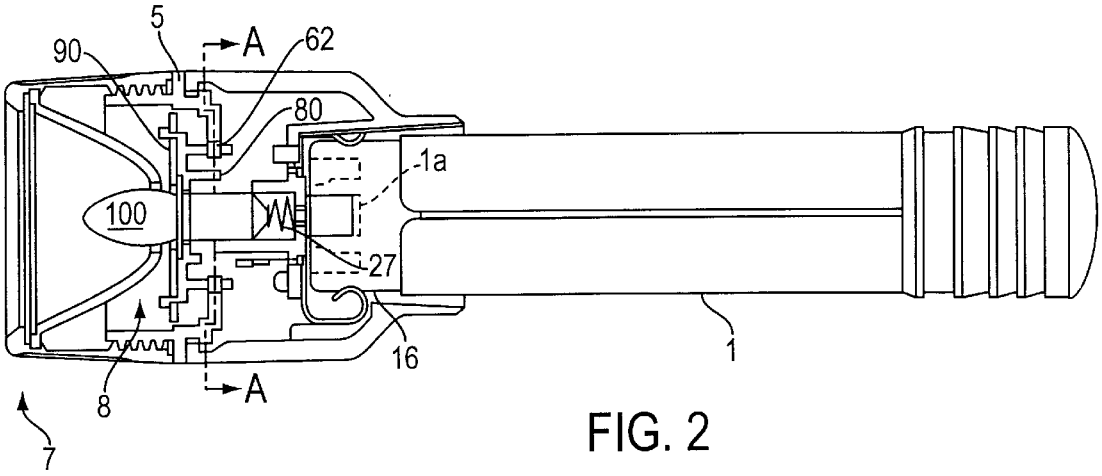
FIG. 2 is a cross-sectional view of the flashlight shown in FIG. 1.

With reference to FIGS. 1 and 2, a flashlight according to the present invention is shown. The flashlight is shown mounted on rechargeable battery 1 as shown and described in U.S. Pat. No. 5,489,484, hereby incorporated by reference. Battery 1 includes cup-shaped positive terminal 1*a* at the center of the forward open end, and metallic outer casing 1*b* which defines the open forward end of the battery and serves as the negative terminal. The flashlight includes housing assembly 2, turning ring 5, head 7 and bulbholder assembly 8. Housing assembly 2 is disposed directly on the forward end of battery 1. Turning ring 5 is rotatably secured on the forward open end of housing assembly 2. Bulbholder 8 is supported within turning ring 5. Head 7 is secured upon turning ring 5 by screw-threading and is rotatable jointly with ring 5.

The flashlight utilizes conventional flashlight bulb 100 including a bulb base defined by outer cylindrical metallic terminal 102 having integral flange 101. Central terminal 103 extends from a bottom tip of the base and is surrounded by an insulator to isolate it from terminal 102.

With further reference to FIGS. 5, 6 and 8–8B, housing assembly 2 further includes housing 20 including rearward cylindrical peripheral wall 23 having a rearward opening into which the forward open end of battery 1 fits. The forward end of the opening is defined by inner surface 24 which is contacted by the forward open end of battery 1. Central metallic rivet 22 is secured to and extends rearwardly from inner surface 24 and is received by positive cup-shaped terminal 1*a*. Two peripherally disposed and bent tab-shaped terminals 21 also are secured to and extend rearwardly from inner surface 24 and receive outer metallic casing 1*b* of battery 1. Rivet 22 and tab-shaped terminals 21 include nubs which extend through openings in inner surface 24 to allow the circuit to be completed from the battery terminals to the opposite side of inner surface 24.

Forward of inner surface 24, housing 20 includes forwardly projecting cup-like flange 26 which has opening 26*a* formed in the periphery for a predefined arcuate and axial extent. Bulb spring 27 is disposed in flange 26 and is linked in electrical contact with the forward nub of rivet 22. Bulb spring 27 forms a positive contact for central terminal 103 of bulb 100. The extending nub of one of tab-shaped terminals 21 is linked in electrical contact with arcuate contact plate 28 which is disposed about flange 26. With reference to FIG. 2A, terminal end portion 28*a* of contact plate 28 is hook-shaped and is located at the position of opening 26*a*, adjacent to bulb outer terminal 102. Contact plate 28 is biased radially outwardly such that terminal end portion 28*a* is out of contact with terminal 102. Contact plate 28 also includes radially outward projecting protuberance 28*b* disposed between terminal end portion 28*a* and the location where plate 28 is linked to the nub of tab terminal 21.

Housing 20 also includes two vertical posts 30*a* and 30*b* disposed outwardly of flange 26 and extending upwardly from inner surface 24. Post 30*a* is disposed adjacent opening 26*a* and outwardly of hook portion 28*a*. Post 30*b* is disposed generally opposite post 30*a*. Vertical wall 29 also extends upwardly from inner surface 24, and is integral with and extends outwardly from flange 26. Housing 20 includes forward cylinder wall portion 25 flaring outwardly from wall 23, and extending forward of flange 26. The forward end of wall portion 25 is open. Arcuate undercut tabs 25*a* extend inwardly at opposite locations along the forward periphery of wall portion 25.

Figure 10A:
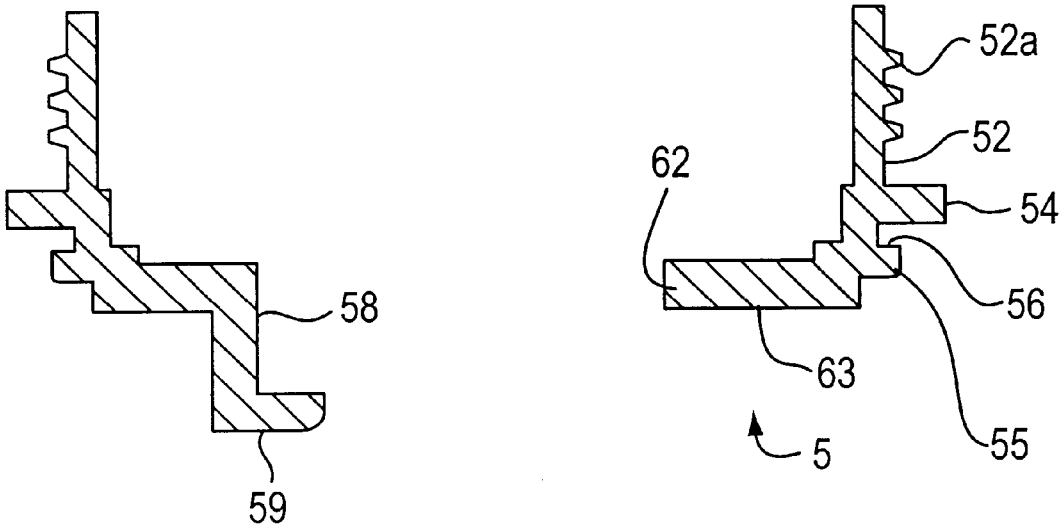
FIG. 10A is a cross-section taken along the line A—A in FIG. 10.
Figure 10B:
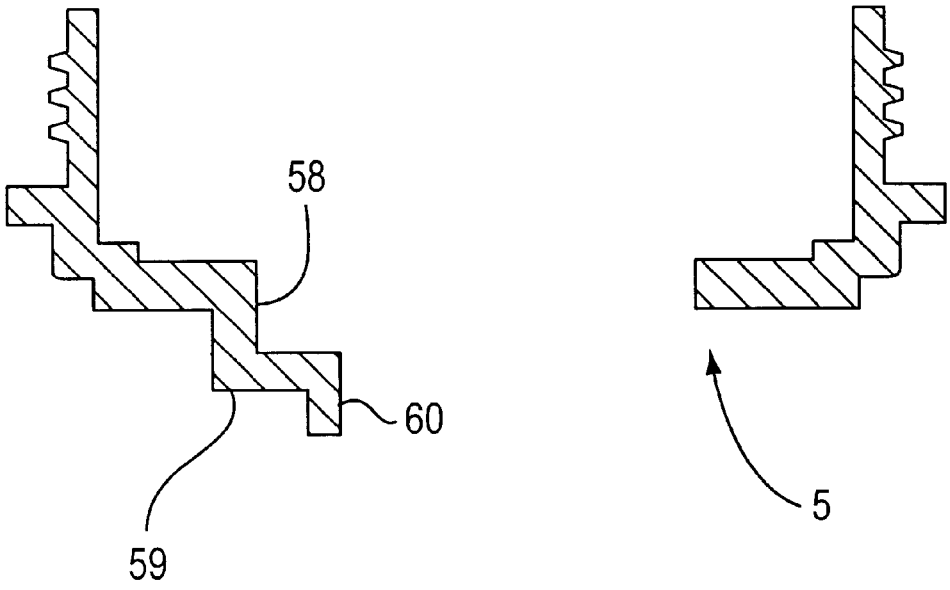
FIG. 10B is a cross-section taken along the line B—B in FIG. 10.
Figure 10:
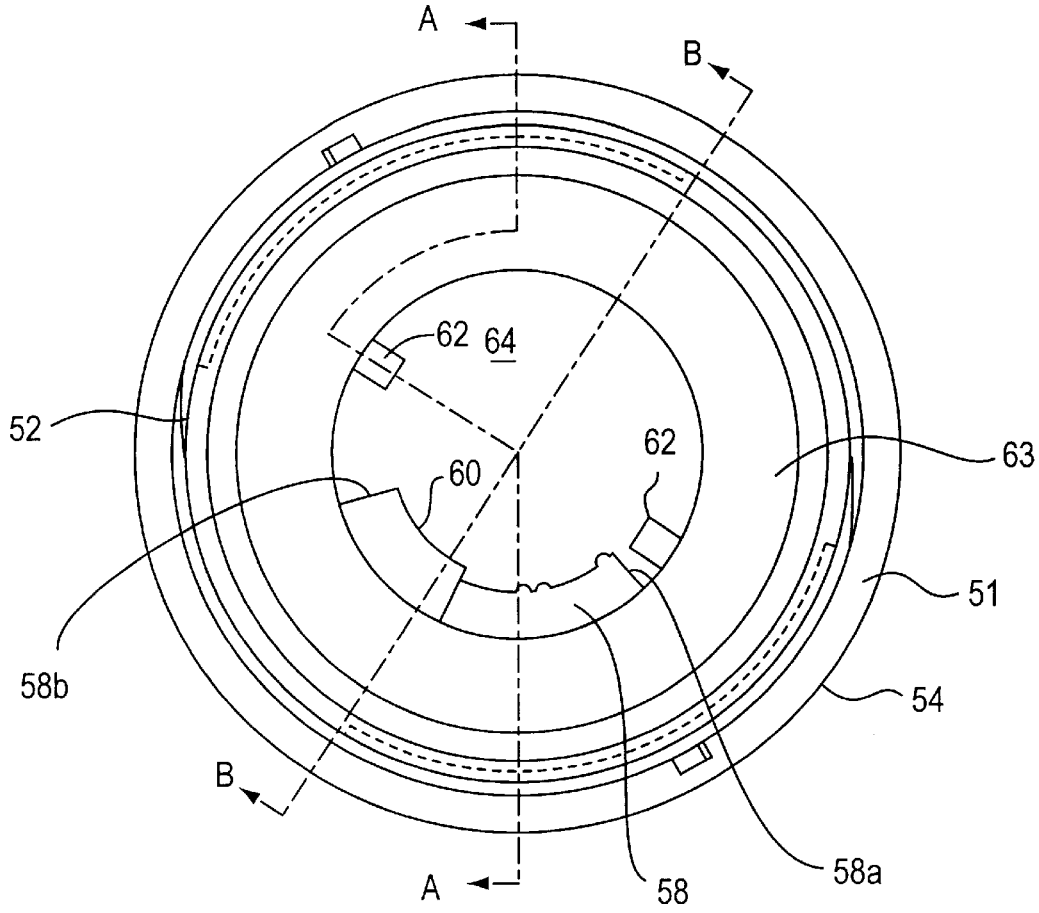
FIG. 10 is a top view of a turning ring forming part of the flashlight shown in FIG. 1.
Figure 10C:
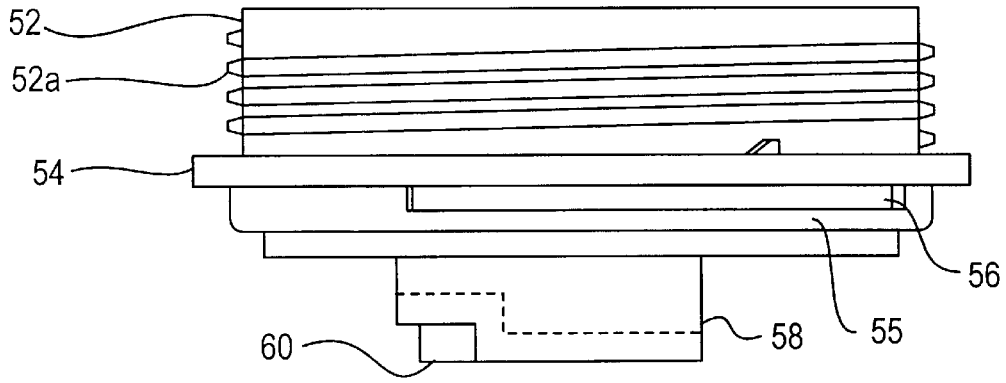
FIG. 10C is a side view of the turning ring shown in FIG. 10.

With reference to FIGS. 10–10*c*, turning ring 5 includes forward cylindrical wall 52 having outer screw-threading 52*a*. Rearward of wall 52, ring 5 includes integral larger diameter outer collar 54 and smaller diameter outer collar 55 which are axially spaced from each other so as to define an axial surface therebetween. Two spaced arcuate recesses 56 are formed on opposite sides of this axial surface. Ring 5 snaps into housing 20 with inward tabs 25*a* fitting within recesses 56. Recesses 56 extend for a greater arcuate extent than tabs 25*a* to allow limited rotation of turning ring 5 relative to housing 20.

Ring 5 includes inner ledge 63 defining central opening 64. Two oppositely disposed pins 62 protrude into opening 54 from ledge 63. Arcuate rib 58 extends downwardly from ledge 63 on one side of central opening 64. Rib 58 has end surfaces 58*a* and 58*b* and includes lower horizontal portion 59 extending inwardly beneath opening 64. Horizontal portion 59 further includes inner vertical wall 60 which extends for a limited arcuate extent and terminates at end 58*b*. Though not shown, a second arcuate rib may extend downwardly along the opposite side of opening 64. Though not visible in FIGS. 2 and 3, rib 58 also is shown in the cross-sectional view of FIG. 4.

As shown in FIG. 2A, when turning ring 5 is snapped onto housing 20, rib 58 is disposed between vertical posts 30*a* and 30*b*. Inner vertical wall 60 is disposed radially outwardly of contact plate 28. The rotation of turning ring 5 relative to housing 20 is limited in either direction by contact of circumferential end surfaces 58*a* and 58*b* of rib 58 with vertical posts 30*a* and 30*b*. At one limit of rotation, one circumferential end surface 58*a* contacts vertical post 30*b*. At this position, vertical inner wall 60 terminates at a position which is closer to vertical post 30*a* than protuberance 28*a*, that is, inner wall 60 is not adjacent to the protuberance. However, rotation of ring 5 causes vertical inner wall 60 to move adjacent and past protuberance 28*a*, until the inner wall contacts post 30*b*.

With reference to FIGS. 7–7*c* and 9*a*–*b*, bulb holder 8 is disclosed. Bulb holder 8 includes bulb holder base 80 and retainer or locking ring 90. Base 80 includes a surface portion defining a central opening 84 having a radius which is slightly larger than bulb outer contact 102, but less than the radius of bulb flange 101. Base 80 also includes two raised tabs 82 at opposite locations of the surface portion. Tabs 82 include outward overhanging portions 82*a* at the upper ends.

Locking ring 90 includes central opening 96 of approximately the same radius as central opening 84, and two arcuate slots 92 disposed at opposite circumferential locations. Arcuate slots 92 have a substantially constant inner diameter, and a stepped outer diameter such that a portion of the slots have a reduced radial thickness. Ring 90 also includes two fins 94 extending upwardly from the upper surface at opposite circumferential locations which are approximately 90° from the locations of the slots.

Bulb 100 is secured in holder 8 by inserting the bulb base through opening 84 of base 80, with bulb flange 101 resting on the surface. Ring 90 is disposed upon base 80, with the bulb lamp fitting within opening 96, and raised tabs 82 including overhanging portions 82*a* fitting within the larger radial thickness portions of arcuate slots 92. Ring 90 is twisted relative to base 80 by grasping fins 94, such that tabs 82 move within the reduced radial thickness portions of slots 92. Overhanging portions 82*a* are disposed above the surface of ring 90 to secure the ring on the base. Ring 90 fits over bulb flange 101, thereby securing bulb 100 in the axial direction within holder 8.

Base 80 includes outer collar 81 extending downwardly from the surface portion and having a radius approximately equal to the radius of opening 64 in turning ring 5. Outer collar 81 includes helical cam slots 85 formed at opposite locations. Slots 85 begin at openings in the lowermost surface of collar 81, and extend laterally upwardly along the collar, terminating at the surface portion of base 80. Slots 85 cause the wall portions of collar 81 to have flexibility in the radial direction. The ends of flexible wall portions include outward tabs 81*a*. Bulb holder base 80 also includes inner collar 83 disposed slightly outwardly of central opening 84. Inner collar 83 includes vertical slot 87 extending to the surface portion of the base. Base 8 is secured in turning ring 5 by disposing outer collar 81 through opening 64. The flexible walls are pressed inwardly to pass collar 81 through the opening. As shown in phantom in FIG. 7*c*, pins 62 extend within helical cam openings 85. Tabs 81*a* of the wall portions extend below ledge 63 of ring 5.

When turning ring 5 is disposed on housing 20 as described above, vertical wall 29 extending from inner surface 24 of the housing fits within vertical opening 87 of base 80 thereby precluding rotation of base 80 and holder 8. Therefore, rotation of turning ring 5 causes pins 62 to move laterally within helical cam slots 85. Since the vertical position of pins 62 is fixed, base 80 must move vertically (axially) up or down to accommodate rotation of pins 62. Retainer ring 90 and bulb 100 retained thereby move with base 80. Accordingly, rotation of ring 5 relative to housing 20 causes axially upward or downward movement of bulb 100.

Figure 4:
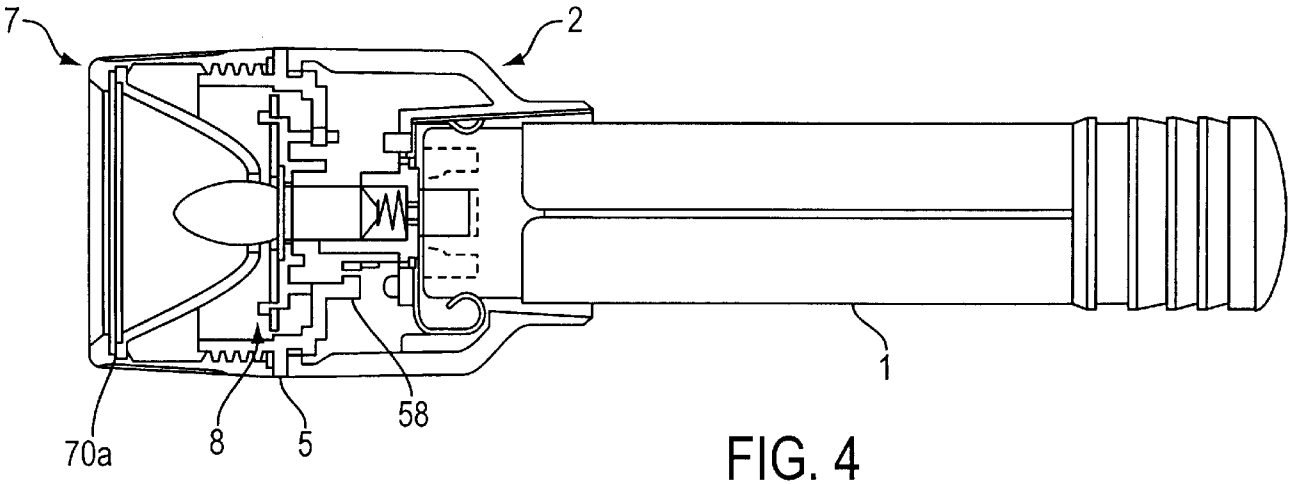
FIG. 4 is a second cross-sectional view of the flashlight shown in FIG. 1.
Figure 5:
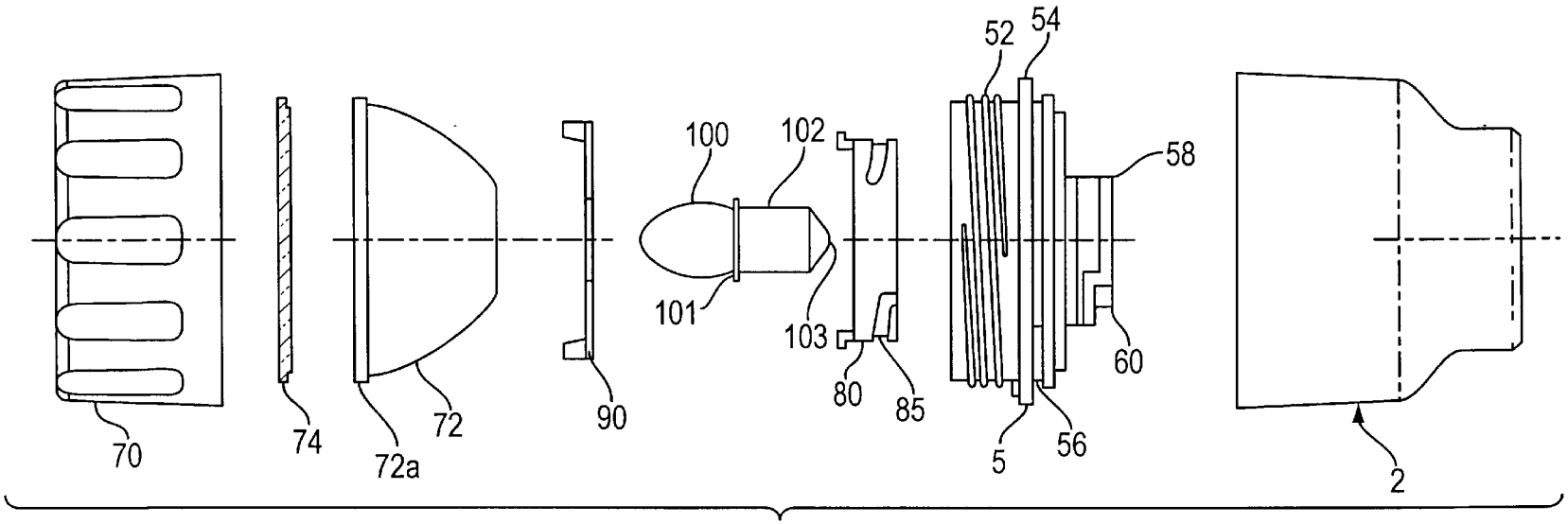
FIG. 5 is an exploded side view of the flashlight shown in FIG. 1.
Figure 6:
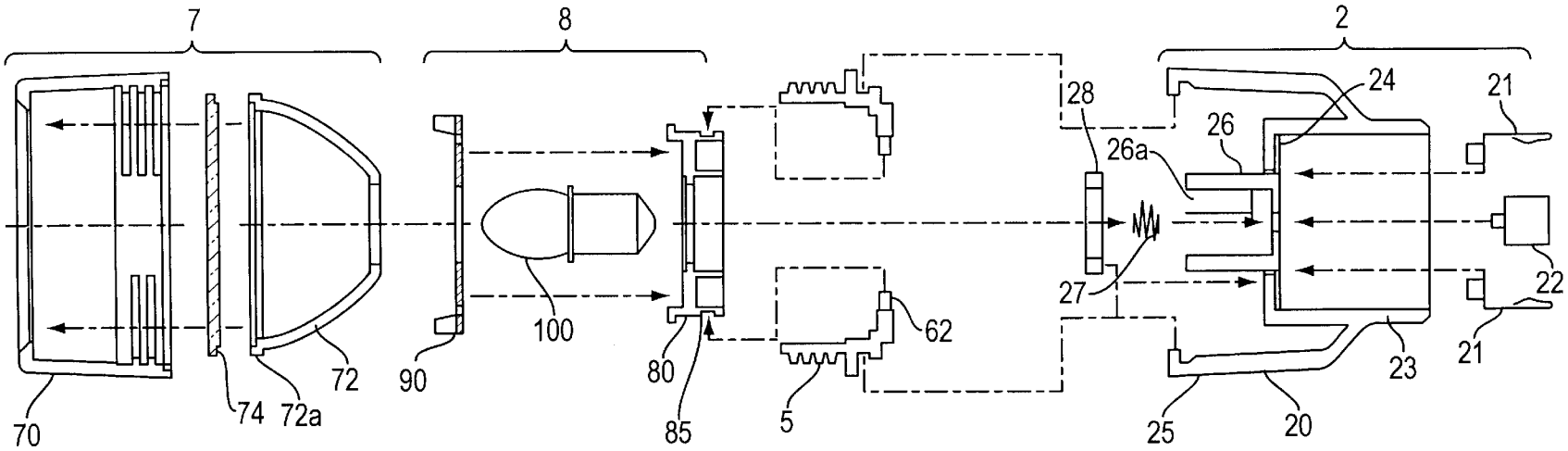
FIG. 6 is an exploded sectional view of the flashlight shown in FIG. 1.
Figure 7:
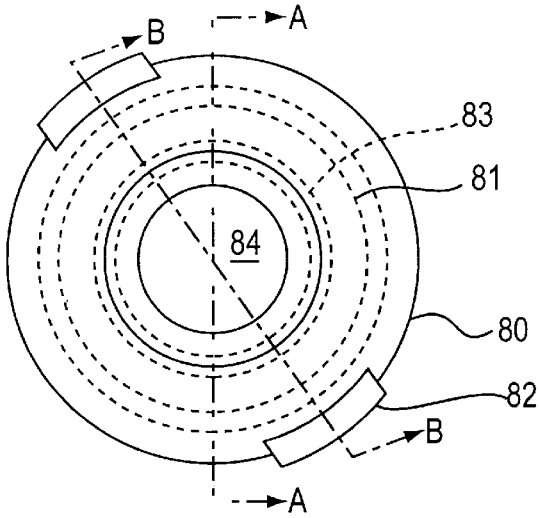
FIG. 7 is a top view of the bulb-holder base forming part of the flashlight shown in FIG. 1.
Figure 7A:
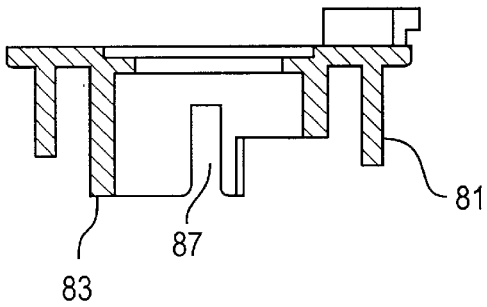
FIG. 7A is a cross-sectional view taken along the line A—A in FIG. 7.
Figure 7B:
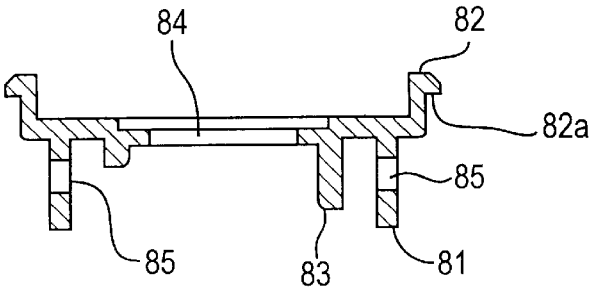
FIG. 7B is a cross-section view taken along the line B—B in FIG. 7.
Figure 7C:
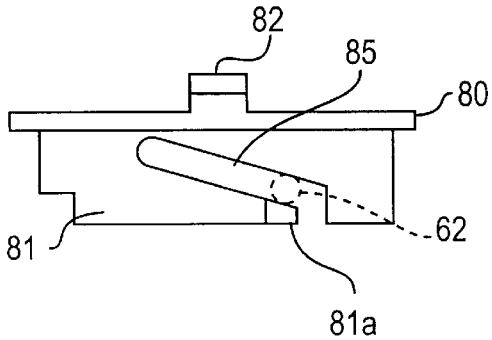
FIG. 7C is a side view of the bulb-holder base shown in FIG. 7.
Figure 8:
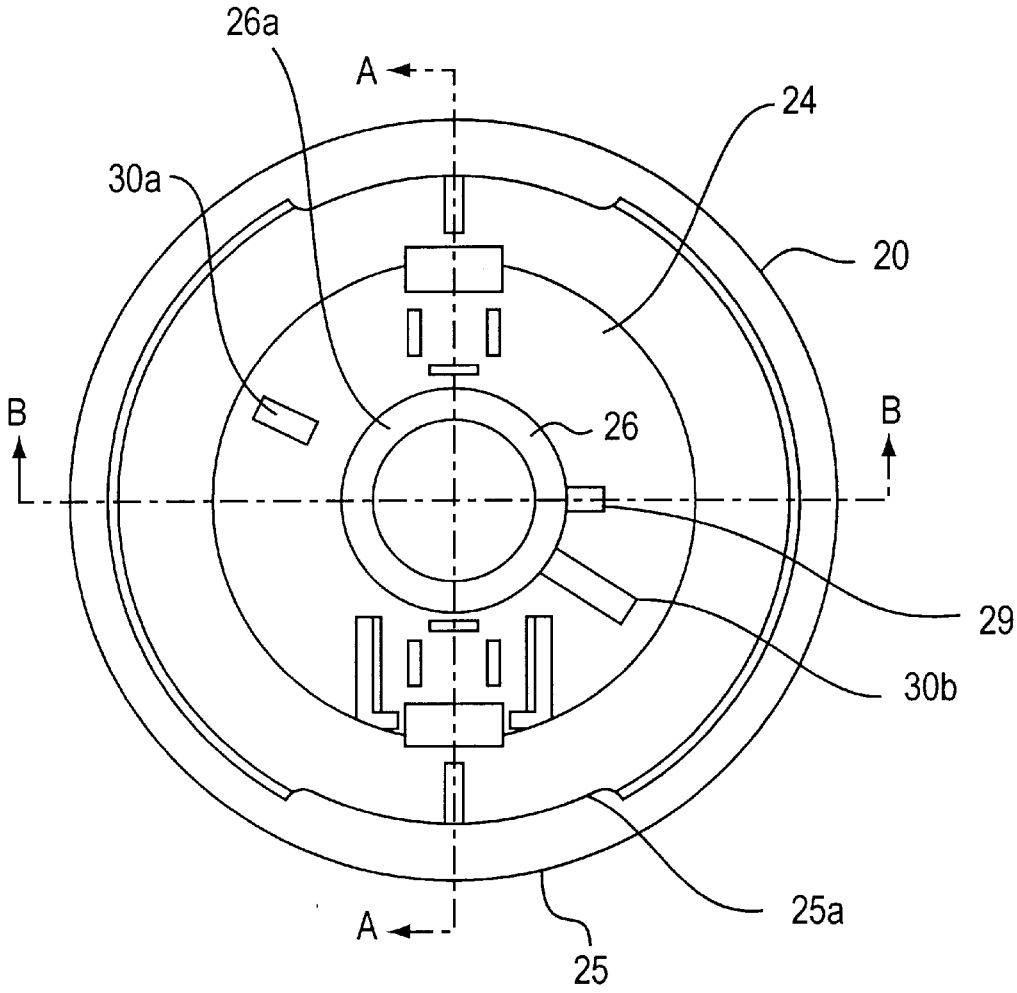
FIG. 8 is a top view of a housing forming part of the flashlight shown in FIG. 1.
Figure 8B:
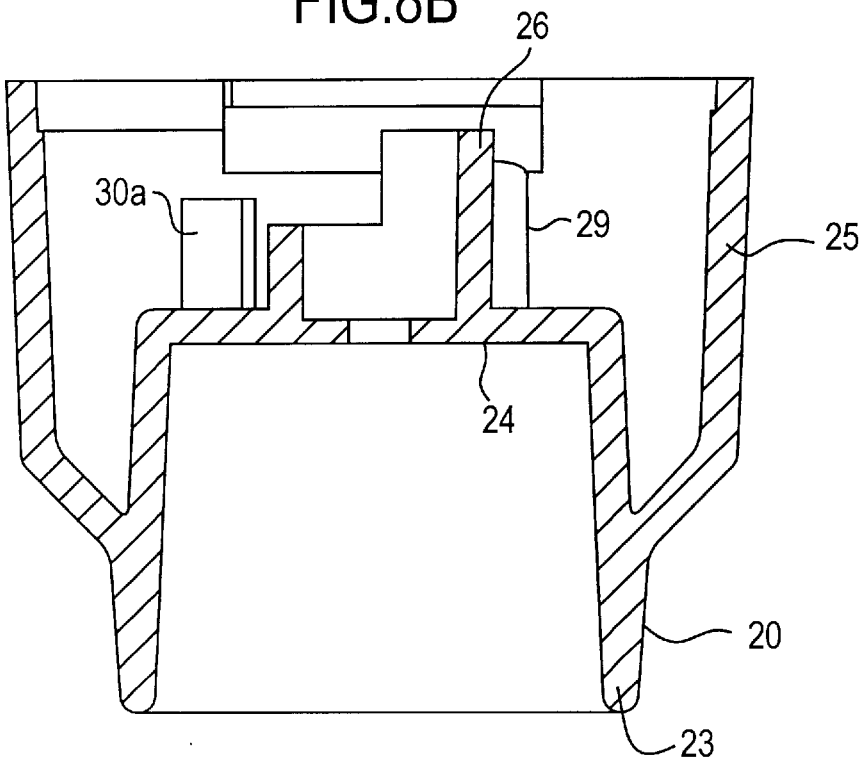
FIG. 8B is a cross-sectional view taken along the line B—B in FIG. 8.
Figure 8A:
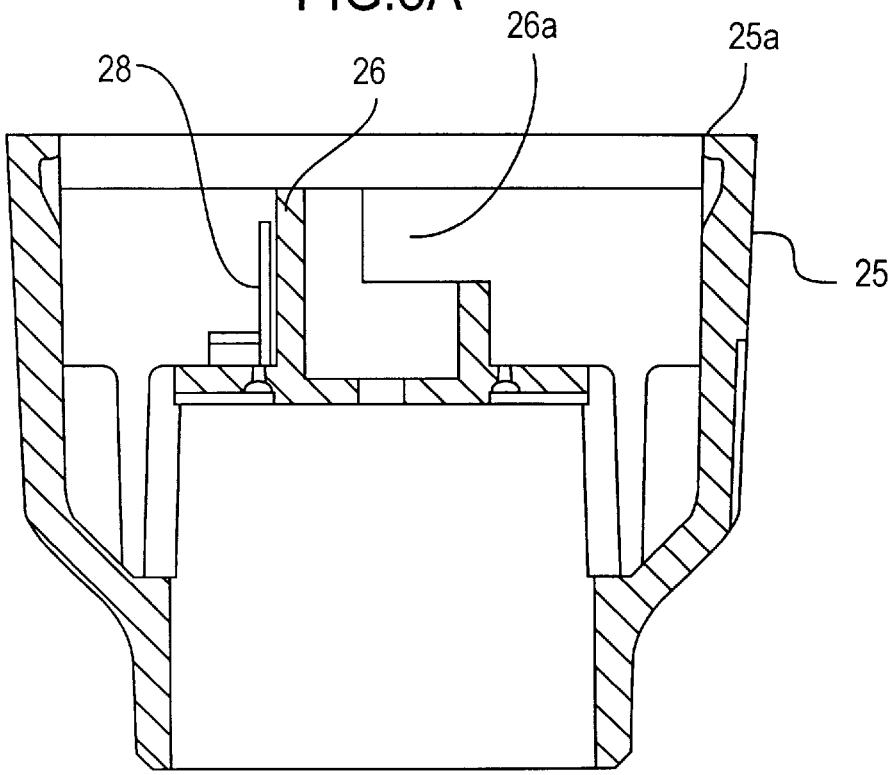
FIG. 8A is a cross-sectional view taken along the line A—A in FIG. 8.
Figure 9A:
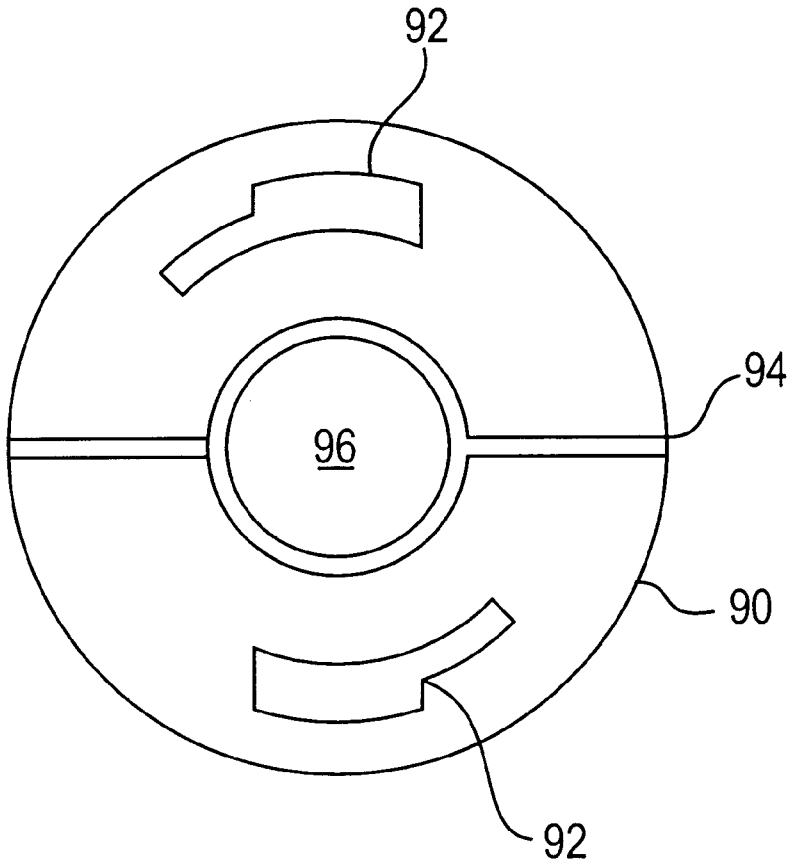
FIG. 9A is a top view of a retainer ring forming part of the flashlight shown in FIG. 1.
Figure 9B:
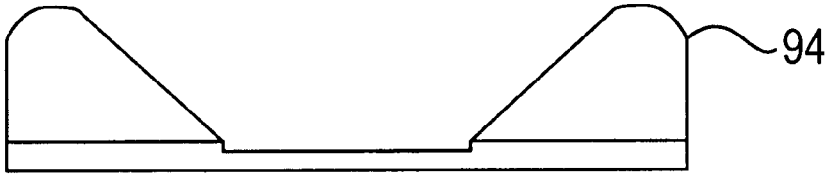
FIG. 9B is a side view of the retainer ring shown in FIG. 9A.

With reference to FIGS. 4 and 5, head section 7 includes screw-threaded bezel 70, lens 74 and reflector 72. Bezel 70 includes inner recesses 70*a* and reflector 72 includes tab 72*a* about the periphery. By insertion of tab 72*a* in recesses 70*a*, bezel 70, lens 74 and reflector are secured together, with the reflector held stationary in the vertical direction. This combined assembly is fixedly secured to ring 5 by the screw-threading. After bezel 70 is secured to ring 5 by rotating the bezel relative to the ring, further rotation of bezel 70 causes joint rotation of ring 5. Therefore rotation of bezel 70 causes axial movement of bulb 100, as well as rotational movement of rib 58. Bulb fits within a central opening of reflector 72, and moves axially relative thereto.

In operation, as shown in FIGS. 2 and 2A, with the flashlight initially off, pins 62 are located near the open ends of helical grooves 85, which is the lowest-most point in the vertical direction. Bulb holder 8 is in the uppermost position relative to turning ring 5, and bulb 100 is in the uppermost position relative to reflector 72. Bulb spring 27 is in an extended state so as to make contact with central contact 103 of bulb 100. End 58*a* of rib 58 abuts vertical post 30*b*, and vertical wall 60 of rib 58 is disposed out of contact with protuberance 28*b*. Accordingly, hook end portion 28*a* of contact 28 is biased radially outwardly relative to opening 26*a* of flange 26, and therefore is not in contact with outer terminal 102 of bulb 100. The circuit is open, and bulb 100 is not illuminated.

Figure 2B:
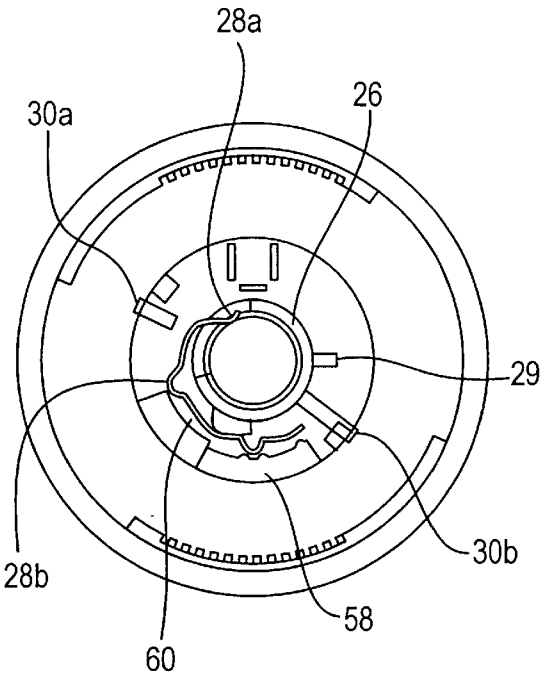
FIG. 2B is a cross-sectional view similar to the view shown in FIG. 2A but showing the turning ring of the flashlight in a second operational position.
Figure 2A:
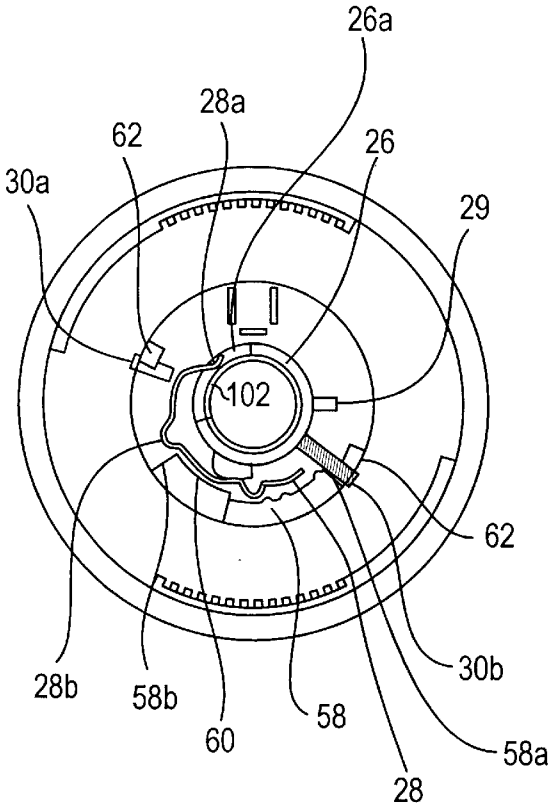
FIG. 2A is a cross-sectional view along the line A—A in FIG. 2.

With reference to FIG. 2B, bezel 70 and turning ring 5 are then rotated relative to housing 20. The initial rotation causes inner vertical wall 60 of rib 58 to slide over protuberance 28*b*, thereby pushing protuberance 28*b* and hook end 28*a* of contact 28 radially inwardly. Hook end 28*a* moves inwardly relative to opening 26*a* of flange 26 and contacts outer terminal 102 of bulb 100 to complete the circuit and illuminate the bulb. Simultaneously, pins 62 begin to travel along helical groove 85 of base 80, forcing base 80 to begin traveling downwardly. Thus, bulb 100 begins to move downwardly relative to reflector 72. At the time of initial illumination, bulb 100 is at the maximum spacing above reflector 72. Accordingly, the light is focused in a narrow beam or spotlight pattern.

Figure 3:
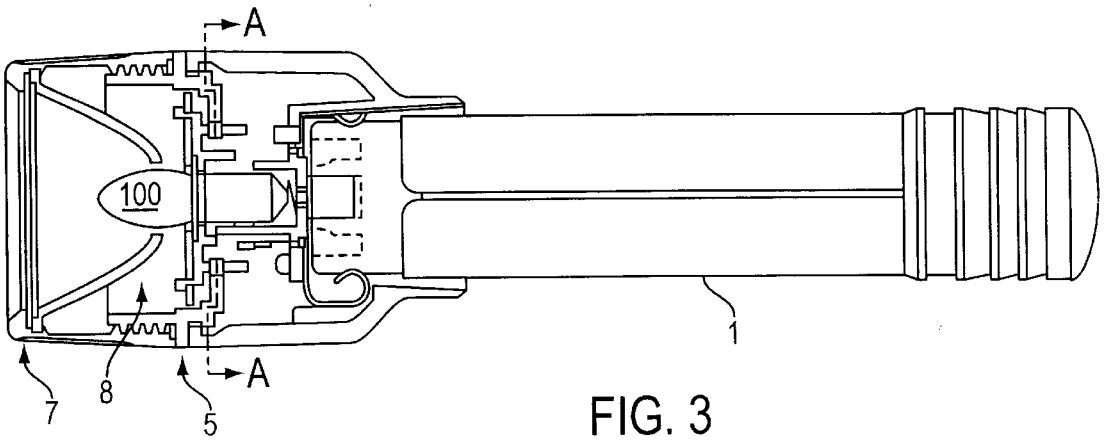
FIG. 3 is a cross-sectional view similar to the view shown in FIG. 2 but showing the bulb and bulb-holder of the flashlight in a second position of focus.
Figure 3A:
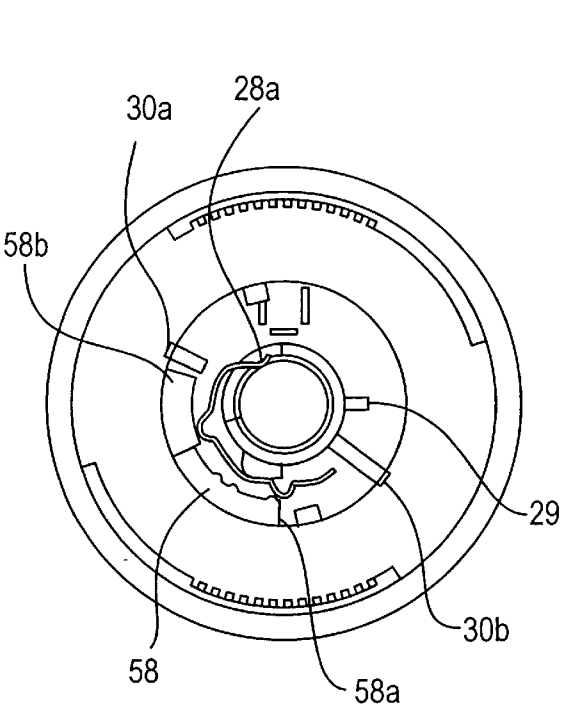
FIG. 3A is a cross-sectional view along the line A—A in FIG. 3.

With reference to FIGS. 3 and 3A, bezel 70 and turning ring 5 may be further rotated until end 58*b* of rib 58 contacts opposite vertical post 30*a*. Throughout the extent of this further rotation, vertical wall 60 of rib 58 is maintained in contact with protuberance 28*a* and bulb 100 remains illuminated. However, the continued movement of pins 62 in helical cam grooves 85 causes continued downward movement of bulb holder 8 and bulb 100. As bulb 100 moves closer to reflector 72, the reflected light is dispersed to a wider, unfocussed beam. Throughout, the extent of axial movement, bulb spring 27 remains in contact with bulb 100.

The circuit may be opened by rotation of bezel 70 and ring 5 in the opposite direction. Further rotation, which is opposite of the direction in which bezel 70 was rotated to secure it on ring 5, will cause bezel 70 to be unscrewed from ring 5. Bezel 70 may be removed in this manner to allow access to retainer ring 90 of bulb holder 8. Retainer ring 90 may be rotated relative to base 80 by grasping fins 94 until the tabs 82 align with the thicker portions of slots 92 and removed from base 80, allowing the bulb to be replaced.

In the figures, housing wall 21 is shown as truncated, such that the user would hold battery 1 to use the flashlight. Of course, the present invention also is applicable to flashlights in which the wall extends further along the battery so as to more completely surround-the battery, and if desired, entirely encase the battery.

We claim:

1. A flashlight for use with a battery having first and second battery terminals and a bulb having a base including a central electrical terminal and an outer electrical terminal, said flashlight comprising:

a housing having an open forward end, said housing having an inner surface and a flange extending upwardly from said inner surface, said flange including a peripheral opening, said housing also including a first electrical contact disposed within said flange and a second electrical contact extending about said flange, said second electrical contact including a terminal end portion disposed adjacent said opening, said portion biased radially outwardly with respect to said opening, both said electrical contacts linkable in a circuit with the battery terminals;

a ring rotatably secured within the open forward end of said housing, said ring having a central opening, said ring including at least one pin extending radially into said central opening, said ring including a rib disposed radially outwardly of said second electrical contact;

a bulb holder having a central opening and a downwardly extending collar, said collar including at least one helical cam slot, said at least one pin fitting within said helical cam slot, a reflector secured against axial movement and disposed forward of said ring, said reflector including an opening, wherein, the bulb is secured by said bulbholder with the base received in said flange with the central terminal disposed in contact with said first electrical contact, the outer bulb terminal disposed adjacent said opening in said flange and the bulb disposed through the opening in the reflector, and relative rotation of said ring and housing causes said rib to force said terminal end portion of said second electrical contact into contact with said bulb outer terminal to complete an electrical circuit, the rotation also causing movement of said pin in said helical cam slot to cause axial movement of said bulb holder and bulb relative to said reflector.

2. The flashlight of claim 1, said ring including a ledge defining said opening, said pin extending radially from said ledge and said rib extending axially from said ledge.

3. The flashlight recited in claim 1, said bulb holder including a second collar having an axial opening therein, said housing including a vertical wall extending upwardly from said inner surface and fitting within said axial opening to substantially secure said bulb holder against rotational movement.

4. The flashlight recited in claim 1, said housing further comprising a pair of vertical posts extending upwardly from said inner surface and disposed radially outwardly of said flange, said rib disposed circumferentially between said vertical posts such that contact of each end of said rib with one of said posts limits the rotational movement of said ring.

5. The flashlight recited in claim 1, said second electrical contact having an arcuate shape and including a terminal end portion and a protuberance, rotation of said ring causing said rib to move over said protuberance to force said terminal end portion into contact with said bulb outer terminal.

6. The flashlight recited in claim 1, said ring including an upwardly extending screw-threaded cylindrical collar, said flashlight further comprising a screw-threaded bezel secured on said screw-threaded cylindrical collar, wherein said reflector is axially fixed within said bezel.

7. A mechanism for a flashlight having a reflector secured against axial motion, the reflector having a central opening, and a bulb including a base having an outer cylindrical electrical terminal, the bulb extending through the central opening of the reflector, said mechanism comprising:

a bulb holder, the bulb secured in said bulb holder and moving jointly in an axial direction with said bulb holder;

an electrical contact disposed in the flashlight adjacent and biased away from the outer terminal of the bulb; and a ring rotatably disposed in the flashlight, said ring mechanically linked to said bulb holder and including an element disposed adjacent said electrical contact; wherein, rotation of said ring causes said bulb holder and thus said bulb to move axially relative to said reflector due to the mechanical link and also causes said element to force said electrical contact against the bias and into contact with said cylindrical electrical terminal of the bulb.

8. The mechanism recited in claim 7, said electrical contact having an arcuate shape and including a terminal end portion and a protuberance, said element of said ring comprising a rib extending downwardly from said ring and disposed radially outwardly of said electrical contact, wherein, rotation of said ring causes said rib to move over said protuberance to force said electrical contact into contact with the bulb.

9. The mechanism recited in claim 7, said ring including a ledge defining a central opening and a pin extending radially into said central opening, said bulb holder including a collar having a helical groove, said pin disposed in said groove to provide the mechanical link.

10. The mechanism recited in claim 1, said electrical contact having an arcuate shape and including a terminal end portion and a protuberance, said element of said ring comprising a rib extending downwardly from said ledge of said ring and disposed radially outwardly of said electrical contact, wherein, rotation of said ring causes said rib to move over said protuberance to force said electrical contact into contact with the bulb terminal.

* * * * *